US009615680B2

(12) United States Patent
LeFevre et al.

(10) Patent No.: US 9,615,680 B2
(45) Date of Patent: Apr. 11, 2017

(54) DEVICE WITH A NUMBER OF STATIONS FOR DISPLAYING A NUMBER OF CONTAINERS

(71) Applicant: The Dial Corporation, Scottsdale, AZ (US)

(72) Inventors: Sabrina LeFevre, Saginaw, MI (US); Mark D. Hannen, Scottsdale, AZ (US)

(73) Assignee: THE DIAL CORPORATION, Scottsdale, AZ (US)

( * ) Notice: Subject to any disclaimer, the term of this patent is extended or adjusted under 35 U.S.C. 154(b) by 0 days.

(21) Appl. No.: 14/315,189

(22) Filed: Jun. 25, 2014

(65) Prior Publication Data

US 2015/0374146 A1 Dec. 31, 2015

(51) Int. Cl.

| | |
|---|---|
| ***A47F 7/28*** | (2006.01) |
| ***A47F 5/04*** | (2006.01) |
| ***B26F 1/38*** | (2006.01) |
| *A47F 5/11* | (2006.01) |
| *B21D 53/36* | (2006.01) |

(52) U.S. Cl.

CPC ..... *A47F 7/285* (2013.01); *A47F 5/04* (2013.01); *A47F 7/283* (2013.01); *B26F 1/38* (2013.01); *A47F 5/112* (2013.01); *B21D 53/36* (2013.01)

(58) Field of Classification Search

CPC ..... A47F 5/112; A47F 5/116; A47F 7/283; A47F 5/04; A47F 7/285; A47B 43/02; A47B 55/06; A47B 73/00; B26F 1/38

USPC .... 206/779, 485, 485.1, 784, 490, 488, 482, 206/493; 211/72, 74

See application file for complete search history.

(56) References Cited

U.S. PATENT DOCUMENTS

| | | | | | |
|---|---|---|---|---|---|
| 1,079,158 | A | * | 11/1913 | Beatty | A47F 5/112 211/72 |
| 1,411,109 | A | * | 3/1922 | Kislovitz | A47F 5/112 248/450 |
| 1,575,034 | A | * | 3/1926 | Brattain | G09F 1/04 211/72 |
| 2,043,070 | A | * | 6/1936 | Rutkowski | B65D 73/0021 206/482 |
| 2,058,542 | A | * | 10/1936 | Wise | G09F 5/042 206/482 |
| 2,102,982 | A | * | 12/1937 | Taylor | A47F 5/025 211/1.53 |
| 2,106,301 | A | * | 1/1938 | Hughes | A47F 5/112 211/72 |

(Continued)

FOREIGN PATENT DOCUMENTS

| | | | | | |
|---|---|---|---|---|---|
| FR | 1370098 | A | * | 8/1964 | A47F 7/283 |
| FR | 2565803 | A1 | * | 12/1985 | A47F 5/112 |

(Continued)

*Primary Examiner* — Stanton L Krycinski

(74) *Attorney, Agent, or Firm* — Steven L. Nichols; Fabian VanCott

(57) ABSTRACT

Methods and device are provided for displaying a container. The device includes a number of stations to receive a number of containers. The container has an angled top and a recessed bottom. The device has an opening with a first end and a second end opposite of one another to receive the container. Each station has a die-cut angle at the first end of the opening to retain the container via the angled top. Each station has a die-cut post at the second end of the opening to retain the container via the recessed bottom.

20 Claims, 10 Drawing Sheets

(56) References Cited

U.S. PATENT DOCUMENTS

| | | | | | |
|---|---|---|---|---|---|
| 2,145,879 | A * | 2/1939 | Jewett | A47F 7/285 | 211/72 |
| 3,130,836 | A * | 4/1964 | Conrad | F25D 25/00 | 206/499 |
| 3,239,177 | A * | 3/1966 | Samsing | B65D 65/24 | 211/13.1 |
| 3,517,801 | A * | 6/1970 | Cote | B65D 5/5007 | 206/756 |
| 4,887,709 | A * | 12/1989 | Shimamine | B65D 73/0085 | 206/457 |
| 6,220,443 | B1 * | 4/2001 | Damaskos | B65D 5/0085 | 206/315.9 |
| 6,269,961 | B1 * | 8/2001 | Porcelli | A47F 5/112 | 211/70.7 |
| D455,956 | S * | 4/2002 | Thompson | D9/415 | |
| 6,460,703 | B1 * | 10/2002 | Thompson | B65D 5/4204 | 206/68 |
| 6,966,446 | B1 * | 11/2005 | Wise | A47F 5/0006 | 206/806 |
| 7,490,726 | B2 * | 2/2009 | Virvo | A47F 7/00 | 206/485 |

FOREIGN PATENT DOCUMENTS

| | | | | | |
|---|---|---|---|---|---|
| FR | 2613920 | A1 * | 10/1988 | A47F 5/112 | |
| FR | 2632503 | A1 * | 12/1989 | A47B 73/00 | |
| FR | 2934948 | A1 * | 2/2010 | A47F 5/112 | |
| FR | WO 2010018322 | A1 * | 2/2010 | A47F 5/112 | |
| GB | 190901102 | A * | 0/1909 | A47F 5/112 | |
| GB | 269473 | A * | 9/1927 | A47F 5/112 | |
| GB | 364167 | A * | 1/1932 | A47F 5/112 | |

* cited by examiner

DEVICE WITH A NUMBER OF STATIONS FOR DISPLAYING A NUMBER OF CONTAINERS

FIELD OF THE INVENTION

The present invention generally relates to a device to display of a container, and more particularly relates to a device to display a container having an angled top and a recessed bottom.

BACKGROUND OF THE INVENTION

Merchandising retailers arrange products in containers to enhance a customer's shopping experience. A retailer may arrange products on a shelf such that similar products are grouped together. A retailer may desire to locate products purchased together close to one another. A display stand may be used to place a product in a location to raise awareness of the product and improve sales of the product. The product may be in a container that has trademark value of a desired aesthetic appearance.

Accordingly, it is desirable to display a container that has a general form such that the form remains visible. In addition, it is desirable to avoid additional packaging that may increase cost and waste. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A device is provided for displaying a container with an angled top and a recessed bottom. The device includes a number of stations to receive a number of containers with an angled top and a recessed bottom. Each station includes an opening with a first end and a second end opposite of one another to receive the container. Each station also includes a die-cut angle at the first end of the opening to retain the container via the angled top and a die-cut post at the second end of the opening to retain the container via the recessed bottom.

A system for displaying a container includes a number of containers, each container having an angled top and a recessed bottom. The system also includes a number of stations for displaying the number of containers. Each station includes an opening to receive the container. The opening includes a die-cut angle at a first end of the opening to retain the angled top of the container and a die-cut post at the second end of the opening to retain the recessed bottom of the container.

A method is provided for making a device for displaying a container. The method includes forming a number of stations in a substrate. Each station includes an opening. The method also includes forming a die-cut angle from a first end of the station and forming a die-cut post from a second end of the station. The second end is on an opposite side of the station from the first end.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

Figure 1A:
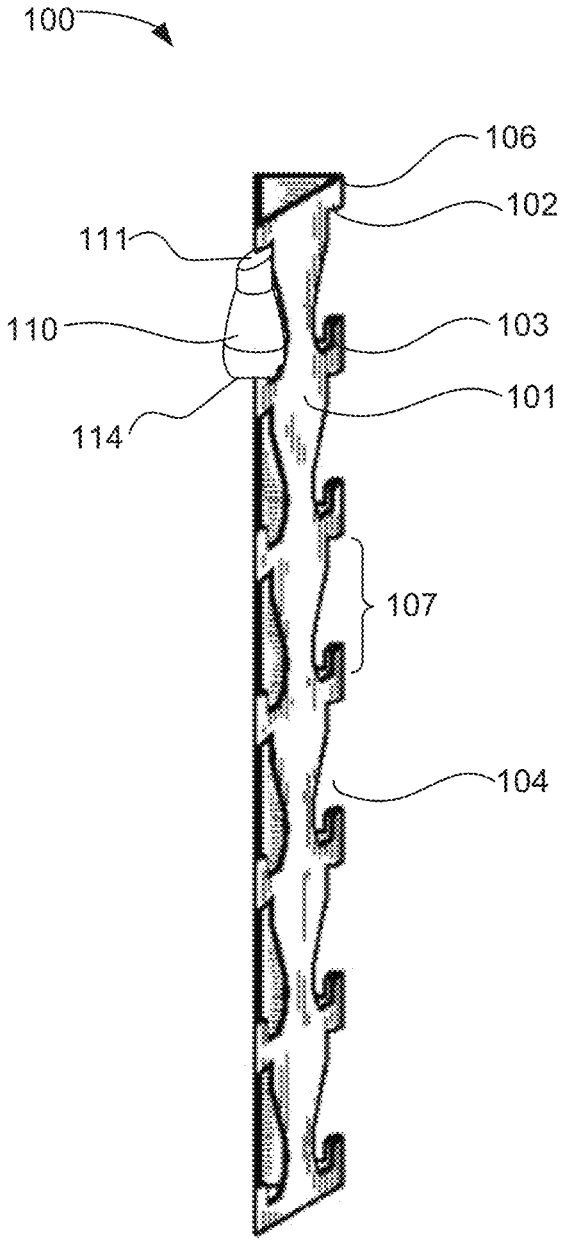
FIG. 1A is an isometric view of a device with a number of stations to display a number of containers with an angled top and a recessed bottom, according to one example of the principles described herein.

The following detailed description of the invention is merely exemplary in nature and is not intended to limit the invention or the application and uses of the invention. Furthermore, there is no intention to be bound by any theory presented in the preceding background of the invention or the following detailed description of the invention.

Merchandising retailers arrange products to enhance a customer's shopping experience. A retailer may desire to place items together to enhance the probability of a consumer purchasing a second product. For example, a customer may purchase an air freshener with toiletry products. However, in a store an air freshener may not be located near toiletry products. For example, a retailer may place air fresheners with cleaning supplies. However, the retailer may desire to place the air fresheners near the toiletries to facilitate a customer purchasing the products together. Accordingly, a device, positioned near the toiletry products, may display air fresheners which may facilitate a customer purchasing these products together.

The placement of items purchased together may change frequently due to the time of year, holidays, or sale prices on products. The constant changing of product placement may be cumbersome for a retailer. For example, a retailer may desire to maintain a consistent store layout and may not wish to repeatedly reorganize shelf space. Moreover, a consistent shelf plan may allow the retailer to enhance the efficiency of stocking a store and may increase consumer appeal via a consistent placement of products within a store. A device that preserves the shape of a container while displaying it may allow a product placement near related products without altering the shelf placement of the container or the shelf set within the store.

A number of devices have been created to address the display of products within a retail environment. These devices may be effective for light-weight and flat packages. However, a product may come in a number of different packages. A device may be sold in a container that is formed to provide aesthetic, trademark, or some other functional purpose. The container or packaging of a product may provide challenges in displaying the product.

A number of products use container features that are both functionally and aesthetically appealing. A container may have a recessed bottom to provide additional stability if the container is subjected to forces that deform the bottom of the container. A recessed bottom may also aid in manufacturing by providing additional material to form a seam joining the bottom of the container and the walls of the container. A container may also have different lids or tops for similar reasons. A container may have an angled top to provide aesthetic appeal.

A device for displaying containers may include a number of stations for displaying the container. Each station may include an opening to receive the container. The opening includes a die-cut angle and a die-cut post. The die-cut post may retain the container by placing a recessed bottom of the container over the die-cut post. The die-cut angle may retain the angled top of the container.

The device may have a number of folds that pass through the die-cut angle and the die-cut post of the openings. The openings may be shaped to conform to the contours of the containers.

The device as described herein may be beneficial by simplifying product placement and securing the product to the display using a simple motion. For example, a container with an angled top and a recessed bottom may be inserted using a place and twist process. A container may also be removed from the display using a twist and remove process. The container may be placed in the display without need for additional packaging or components.

A method may be used for making a device to display a container. The method includes forming a number of stations in a substrate, each station being defined by an opening. The method includes forming a die-cut angle at one end of the station, and forming a die-cut post at the opposite end of the station.

The method may include forming the substrate to support the device as a display. The substrate may also be formed with a plurality of folds, each fold passing through the die-cut angle and die-cut post of a station.

A device that preserves the aesthetic and trademark value of a container while providing a method to display the product may be beneficial to retailers. The device may reduce packaging related costs and waste while allowing the product to be placed in visible locations. A device to display a container with an angled top and recessed bottom may provide retailers with additional alternatives in displaying products in containers of this type.

Retailers may benefit from devices and methods for displaying selected products as described herein. A display designed for a specific product may allow for the merchandising of a product in a method to attract the attention of a customer to the product. A display designed for a specific product may reduce the packaging alterations that may be used to display the product. A reduction in packaging may reduce the cost of production and the waste generated by a product.

As used in the present specification and in the appended claims, the term "product" is any item that may be displayed for view, sale, or distribution. A "container" refers to the packaging of the product that defines the product's shape while on display. The container may serve as a functional part of the product, or may be intended to be disposed of when the product is consumed.

Further, as used in the present specification and in the appended claims, the term "a number of" or similar language may include any positive number, including one to infinity; zero not being a number, but the absence of a number.

FIG. 1A is an isometric view of a device (100) with a number of stations (107) to display a number of containers (110), the container (110) having an angled top (111) and a recessed bottom (114), according to one example of the principles described herein. More specifically, the device (100) includes a substrate (101) that may include a number of stations (107) to receive containers (110) having an angled top (111) and a recessed bottom (114).

The substrate (101) may be constructed out of a number of materials. More specifically, the substrate (101) may be constructed out of any material that provides rigidity and support for a container (110) in the device (100). For example, the substrate (101) may be constructed out of a paper product such as cardboard or corrugated paper board. The substrate (101) may be constructed from other rigid materials such as plastic, metal, metal alloys, glass, or similar material. In some examples, the substrate (101) may be constructed out of a composite of several different materials, or may include a number of different materials constructed together to form the substrate (101). While specific reference is made to particular substrate (101) materials, the substrate (101) may be made of any material that provides support to the containers (110).

The device (100) may include a number of stations (107) for displaying the containers (110). Each station (107) may include an opening (104) to retain the container (110) via the angled top (111) of the container (110) and the recessed bottom (114) of the container (110). The station (107) may be constructed by forming the substrate (101) to have an opening (104). The opening (104) may also be constructed by cutting or removing the material of the substrate (101) to form the opening (104). Material in the substrate (101) may be folded, bent, or shaped to form the station (107).

The opening (104) may be shaped to the contours of the container (110), or may provide additional space around the container (110). Forming the opening (104) to the contour of the container (110) may provide additional support to the container (110) and may allow a device (100) to be formed for a specific container (110) display. A container (110) may also be displayed where the opening (104) provides space around the container (110). Space around the container (110) may allow for greater visibility of the container (110). The opening (104) may also be sized to receive a number of different products, each product in a different container (110) with a different contour.

Each opening (104) may have a first end and a second end opposite of one another to receive the container (110). At the first end, the opening (104) may have a die-cut angle (102) to retain the container (110) via the angled top (111). At the second end, the opening (104) may have a die-cut post (103) to retain the container (110) by the recessed bottom (114).

As described above, the die-cut angle (102) at a first end of the opening (104) may retain the angled top (111) of the container (110). The die-cut angle (102) may have an angle that matches the angled top (111) of the container (110) and may provide resistance against the angled top (111) to retain the container (110) on the die-cut post (103). The die-cut angle (102) may hold the container (110) in line with the die-cut post (103). The die-cut angle (102) may be shaped to contact the angled top (111). In this example, the die-cut angle (102) may contact the angled top (111) of the container (110) along a side of the die-cut angle (102).

A die-cut post (103) at a second end of the opening (104), opposite the first end may retain a container (110) having a recessed bottom (114). A container (110) with a recessed bottom (114) and an angled top (111) is inserted into the device (100) by placing the recessed bottom (114) over the die-cut post (103) with a short side facing the device (100). The container (110) is tilted so that the angled top (111) is proximate to the die-cut angle (102). The container (110) may then be rotated about the axis formed by the die-cut angle (102) and the die-cut post (103) so that the container (110) is secured in the station (107) via the angled top (111) resting against the die-cut angle (102). More detail concerning the insertion of a container (110) into the device (100) is given below in connection with FIGS. 10A-10D.

The device (100) may also have a number of folds (106) to allow the device (100) to stand independently, or to protect the container (110) while being displayed. For example, extending the substrate (101) beyond the container (110) allows the substrate (101) to inhibit contact with the container (110) from the direction the substrate (101) extends. The prevention of contact may permit the system (100) to be displayed against another display, such as a shelf. By preventing contact with the container (110), the system (100) may be hung from a shelf and may rest against the shelf while displaying a number of containers (110).

The number of folds (106) may alter the presentation of the opening (104) of the station (107). A fold (106) may be constructed by bending or forming a single piece of the substrate (101). The substrate (101) may also be formed by joining a plurality of pieces of material to form a joint. A fold (106) may be constructed by joining a plurality of pieces of substrate in a joint. The fold (106), or joint, may pass through the die-cut angle (102) and die-cut post (103).

The folds (106) in the substrate (101) may be formed to create a stand, allowing the device (100) to stand on a surface without additional support. The device (100) may also be supported by other mechanisms. This support may be in the form of a base that the device (100) is inserted into, so that the base provides additional stability to the device (100). In some examples, the device (100) may include an opening such that the device may be suspended from a hook on a shelf.

Figure 1B:
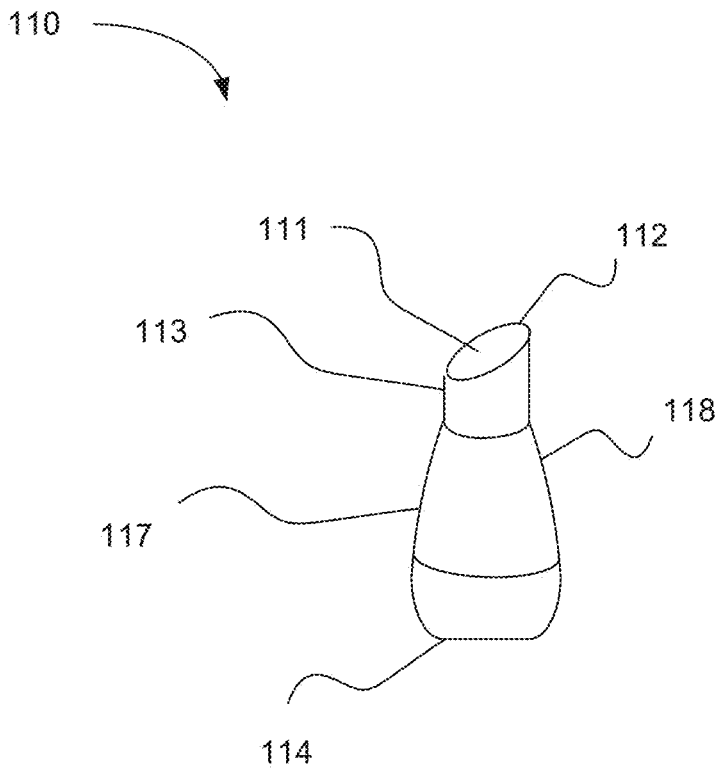
FIG. 1B illustrates a container having an angled top and a recessed bottom, according to one example of the principles described herein.

FIG. 1B illustrates a container (110) having an angled top (111) and a recessed bottom (114), according to one example of the principles described herein. The angled top (111) may have a high end (112) and a low end (113). The high end (112) of the angled top (111) forming a long side (118) of the container (110) by creating a greater distance between the recessed bottom (114) and the angled top (111). The low end (113) of the angled top (111) forming a short side (117) of the container (110). The short side (117) has a smaller distance between the angled top (111) and the recessed bottom (114).

A container (110) may be placed in the device (100) by placing the recessed bottom (114) over the die-cut post (103) and turning the short side (117) toward the device (100). The angled top (111) may be brought so that it is proximate to the die-cut angle (102). By rotating the container (110) so that the short side (117) of the container (110) faces away from the device (100) and the long side (118) is rotated toward the device (100), the device (100) may retain the container (110). More specifically, the angled top (111) may be held in the device (100), and may prevent the container (100) from being unintentionally released from the device (100). More detail concerning the placement and retention of the container (110) within the device is given below in connection with FIGS. 10-13.

Figure 2:
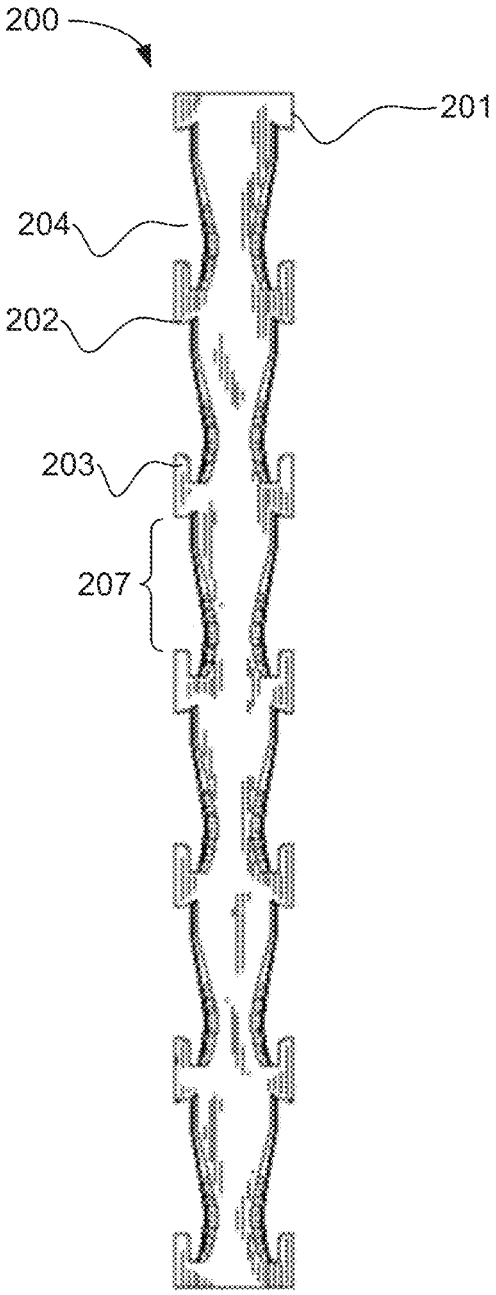
FIG. 2 is a front view of a device with a number of stations to display a number of containers, according to one example of the principles described herein.

FIG. 2 is a front view of a device (200) with a number of stations (207) to display a number of containers (FIG. 1, 110), according to one example of the principles described herein. The device (200) may have a die-cut angle (202) and a die-cut post (203) as described above. A container (FIG. 1, 110) with a recessed bottom (FIG. 1, 114) may rest on the die-cut post (203), and be held in the device (200) by the die-cut angle (202).

As described above, the device (200) may be constructed from a substrate (201). The device (200) may include a number of stations (207), each station (207) having an opening (204) which has a first end with a die-cut angle (202) and, opposite the first end, a second end with a die-cut post (203). The opening (204) may be contoured to the shape of a container (FIG. 1A, 110). Contouring the opening (204) to the shape of the container (FIG. 1A, 110) may be beneficial by reducing the shape and size of the display as well as displaying the container (FIG. 1A, 110) in an aesthetically pleasing fashion.

Figure 3:
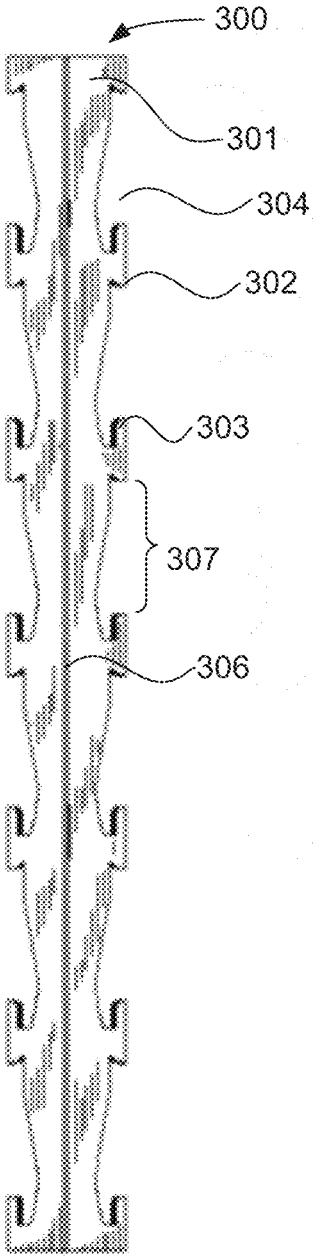
FIG. 3 is a rear view of a device with a number of stations to display a number of containers, according to one example of the principles described herein.

FIG. 3 is a rear view of a device (300) with a number of stations (307) to display a number of containers (FIG. 1, 110), according to one example of the principles described herein. The station (307) includes of an opening (304) that may be contoured, a die-cut angle (302), and a die-cut post (303). The substrate (301) may have a fold (306) passing through a number of stations (307). The number of folds (306) present in the device (300) may to permit the device (300) to stand independently, or to prevent contact with a container (FIG. 1, 110) from a number of directions.

Figure 4:
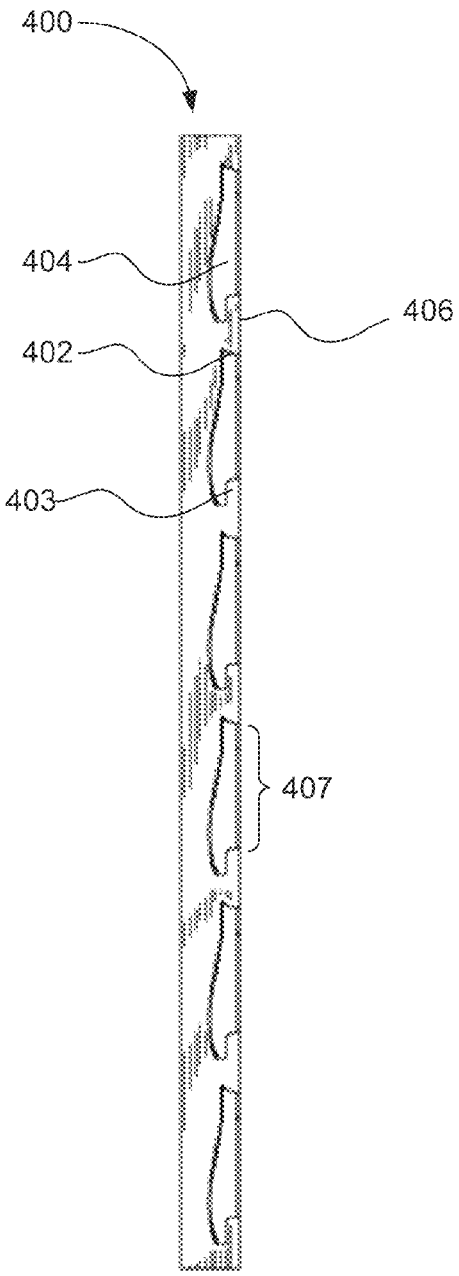
FIG. 4 is a side view of a device with a number of stations to display a number of containers, according to one example of the principles described herein.
Figure 5:
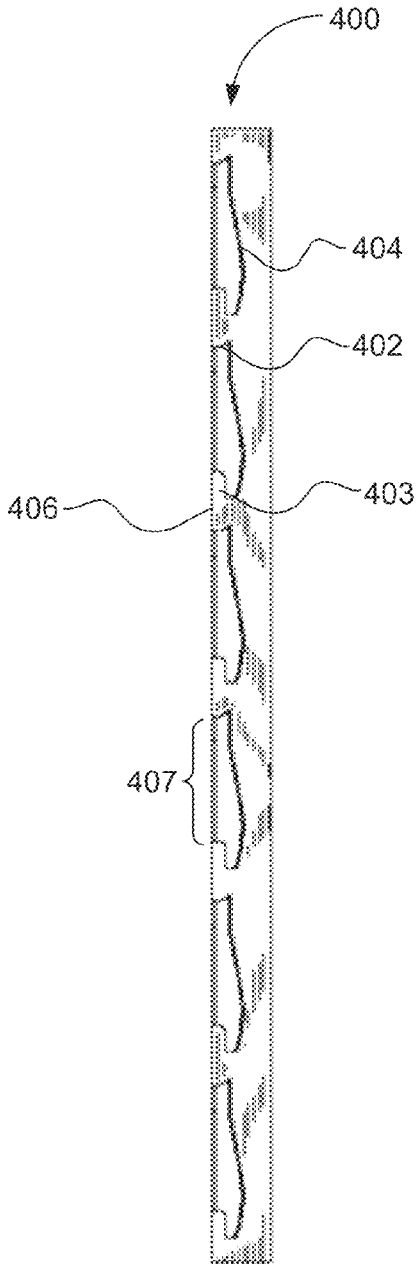
FIG. 5 is another side view of a device with a number of stations to display a number of containers, according to one example of the principles described herein.

FIGS. 4 and 5 are side views of a device (400) with a number of stations (407) to display a number of containers (FIG. 1, 110), according to examples of the principles described herein. The station (407) includes an opening (404) that is contoured, a die-cut angle (402) at a first end and a die-cut post (403) at a second end opposite the first end. A fold (406) may pass through the die-cut angle (402) and the die-cut post (403).

Figure 6:
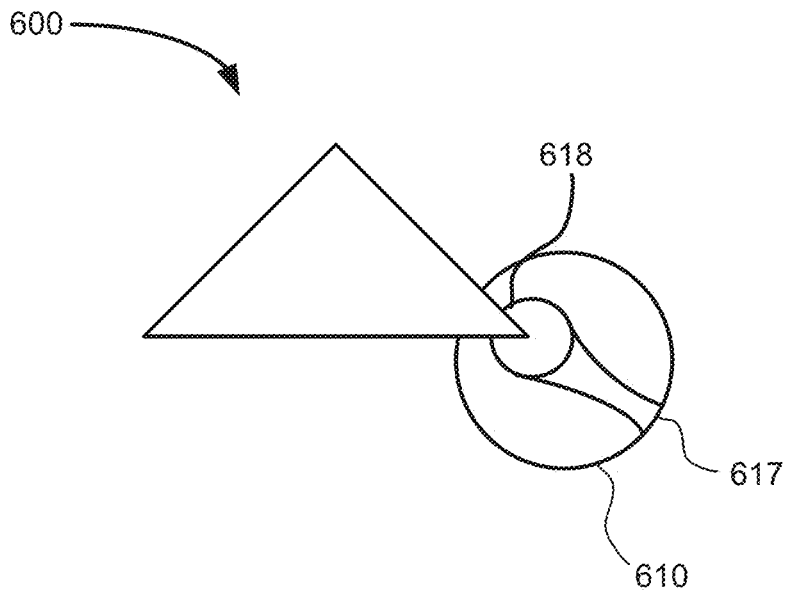
FIG. 6 is a top view of a device with a number of stations to display a number of containers, according to one example of the principles described herein.

FIG. 6 is a top view of a device (600) with a number of stations (FIG. 1, 107) to display a number of containers (610), according to one example of the principles described herein. As described above, a container (610) is placed in the station (FIG. 1, 107) and held to the device (600) via the angled top (FIG. 1, 111) of the container (610) and the recessed bottom (FIG. 1, 114) of the container (610). Specifically, in regards to the angled top (FIG. 1, 111), the container (610) may be placed in the device (600) with the long side (618) of the container (610) located closer to a center line of the device (600) than the short side (617) of the container. (610). In this fashion, the container (610) is placed such that a long side (618) is retained by the die cut angle top (FIG. 1, 102)

Figure 7:
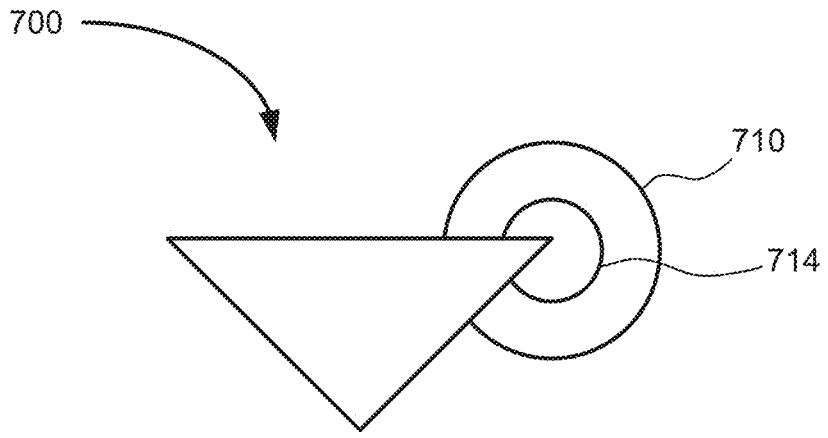
FIG. 7 is a bottom view of a device with a number of stations to display a number of containers, according to one example of the principles described herein.

FIG. 7 is a bottom view of a device (700) with a number of stations (FIG. 1, 107) to display a number of containers (710), according to one example of the principles described herein. As described above, a container (710) is placed in the station (FIG. 1, 107) and held to the device (700) via the recessed bottom (714) of the container (710). Specifically, the recessed bottom (714) may be placed over the die-cut post (FIG. 1, 103). Accordingly, as the container (710) is rotated into place, the container (710) is retained in its place at least in part by the die cut post (FIG. 1, 103) and the recessed bottom (714) of the container (710).

Figure 8:
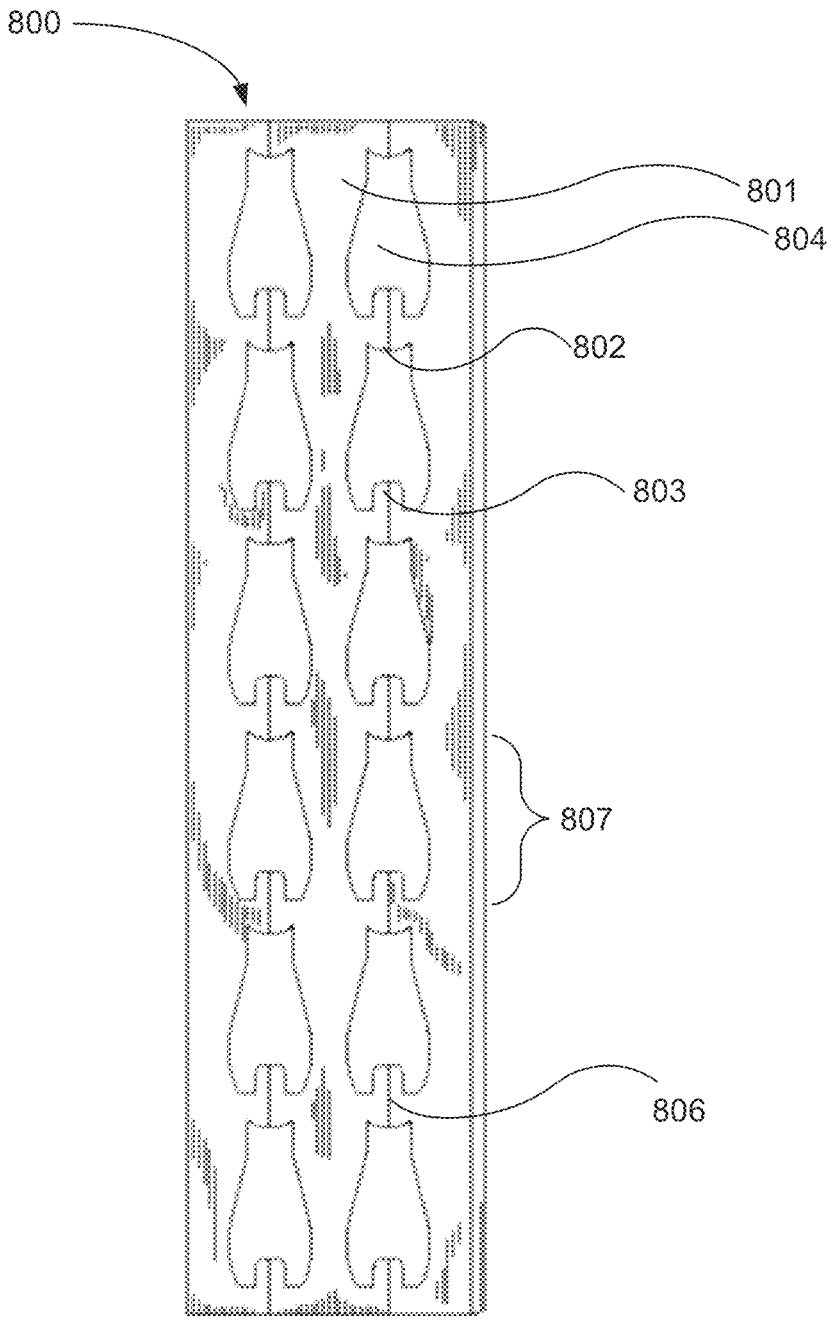
FIG. 8 is a front view of a device with a number of stations to display a number of containers, according to one example of the principles described herein.

FIG. 8 is a front view of a device (800) with a number of stations (807) to display a number of containers (FIG. 1, 110), according to one example of the principles described herein. More specifically, FIG. 8 depicts a front surface of the substrate (801) prior to formation of the folds (806) described above. A station (807) may consist of an opening (804), a die-cut angle (802), and a die-cut post (803). The substrate (801) may include a number of folds (806) and a number of stations (807). A number of additional folds (806) may allow the device (800) to stand independently, or to prevent contact with a container (FIG. 1, 110) from a number of directions.

Figure 9:
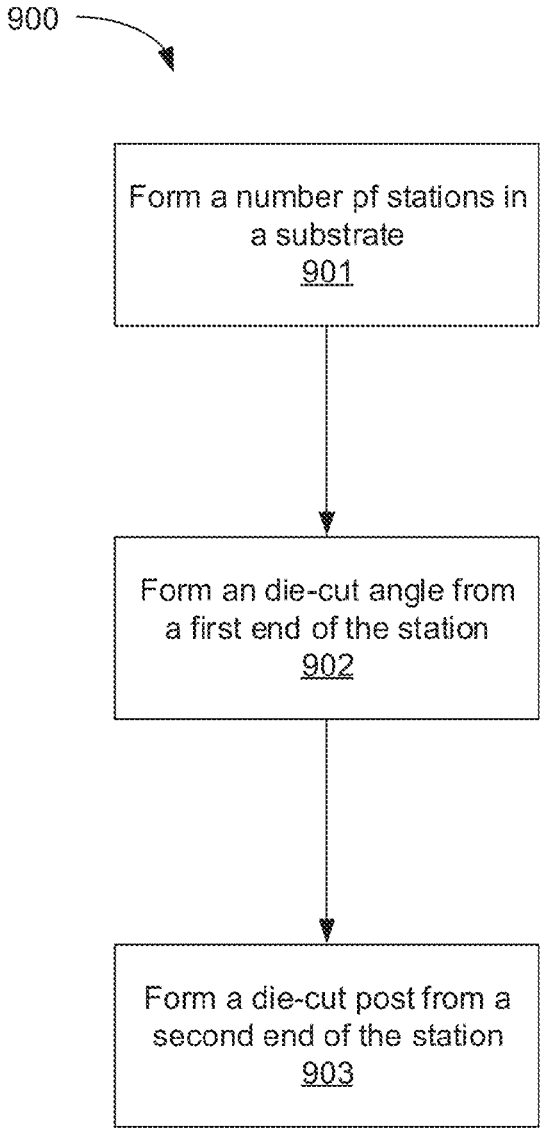
FIG. 9 is a flow chart of a method for making a device with a number of stations to display a number of containers, according to one example of the principles described herein.

FIG. 9 is a flow chart of a method (900) for making a device (FIG. 1, 100) with a number of stations (FIG. 1, 107) to display a number of containers (FIG. 1, 110), according to one example of the principles described herein. The method (900) includes forming (block 901) a number of stations (FIG. 1, 107) in a substrate (FIG. 1, 101), each station (FIG. 1, 107) having an opening (FIG. 1, 104). The method (900) also includes forming (block 902) a die-cut angle (FIG. 1, 102) from a first end of the station (FIG. 1, 107). The method (900) also includes forming (block 903) a die-cut post (FIG. 1, 103) from a second end of the station (FIG. 1, 107), the second end being on an opposite side of the station (FIG. 1, 107) from the first end.

Forming (block 901) a number of stations (FIG. 1, 107) may include forming the substrate (FIG. 1, 101) with an opening (FIG. 1. 104) to display a container (FIG. 1, 110). As described above, the substrate (FIG. 1, 101) may be made of any number of materials that provides rigidity to the device (FIG. 1, 100) and that supports a number of containers (FIG. 1, 110) displayed in the device (FIG. 1, 100). Forming (block 901) the opening (FIG. 1, 104) may including cutting, or otherwise removing material from, the substrate (FIG. 1, 101). The material that formerly occupied the opening (FIG. 1, 104) may be removed, or may be folded or molded to allow space for a container (FIG. 1, 110).

The method (900) also includes forming (block 902) a die-cut angle (FIG. 1, 102) at a first end of the station (FIG. 1, 107). For example, while cutting the opening (FIG. 1, 104), a portion of the substrate (FIG. 1, 101) may be retained as the die-cut angle (FIG. 1, 102). By forming (block 902) a die-cut angle (FIG. 1, 102) from a first end of the station (FIG. 1, 107), a container (FIG. 1, 110) with an angled top (FIG. 1, 111) may be retained. For example, the die-cut angle (FIG. 1, 102) may come in contact with an angled top (FIG. 1, 111) of a container (FIG. 1, 110), allowing the die-cut angle (FIG. 1, 102) to hold a container (FIG. 1, 110) in place. The die-cut angle (FIG. 1, 102) may be formed to provide contact with the angled top (FIG. 1. 102), increasing friction so that the angled top (FIG. 1, 102) does not move without additional force being applied.

The method (900) also includes forming (block 903) a die-cut post (FIG. 1, 103) at a second end of the station (FIG. 1, 107). For example, while cutting the opening (FIG. 1, 104), a portion of the substrate (FIG. 1, 101) may be retained as the die-cut post (FIG. 1, 103). By forming (block 903) a die-cut post (FIG. 1, 103) from a second end of the station (FIG. 1, 107), the second end being on an opposite side of the station (FIG. 1, 107) from the first end, a container (FIG. 1, 110) with a recessed bottom (FIG. 1, 114) may be placed on the die-cut post (FIG. 1, 114). The recessed bottom (FIG. 1, 114) can be placed over the die-cut post (FIG. 1, 103), allowing the die-cut post (FIG. 1, 103) to retain the container (FIG. 1, 110).

The method (900) may further include forming a mechanism in the substrate (FIG. 1, 101) for supporting the device (FIG. 1, 100) as a display. The mechanism may include a plurality of folds (FIG. 1, 106) so that the device (FIG. 1, 100) may stand without support. The mechanism may allow for the device (FIG. 1, 100) to attach to another item to create a display. The other item may be a base structure that provides additional stability or mass to prevent the display from tipping. The other item may also be a mechanism for suspending the device (FIG. 1, 100). Such a mechanism may be a hook, line, hanger, or catch to attach the device (FIG. 1, 100) to a surface that is either at the same level or above the device (FIG. 1, 100).

The method (900) may include forming the substrate (FIG. 1, 101) to have a number of folds (FIG. 1, 106), wherein each fold (FIG. 1, 106) passes through the die-cut angle (FIG. 1, 102) and the die-cut post (FIG. 1, 103) of a station (FIG. 1, 107). The folds (FIG. 1, 106) may increase the stability of the container (FIG. 1, 110) by providing non-linear contact points between the device (FIG. 1, 100) and the container (FIG. 1, 110). The folds (FIG. 1, 106) may further form the device (FIG. 1, 100) such that it may stand independently.

Figure 10A:
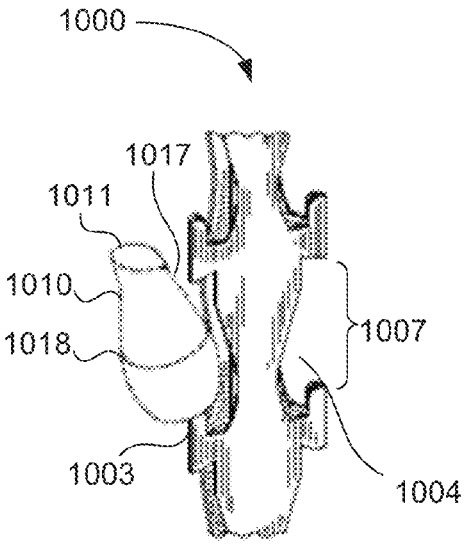
FIGS. 10A-10D are diagrams illustrating the insertion of a container into a device to display the container, according to one example of the principles described herein.

FIGS. 10A-10D are diagrams illustrating the insertion of a container (1010) into a device (1000) to display the container (1010), according to one example of the principles described herein. More specifically, FIG. 10A illustrates a container (1010) being placed in a station (1007) of the device (1000). The container (1010) is angled so that the recessed bottom (FIG. 1, 114) can be inserted into the opening (1004) and placed over the die-cut post (1003). The container (1010) may have an angled top (1011) forming a long side (1018) and a short side (1017) of the container. The container (1010) is oriented such that the short side (1017) of the container (1010) faces the device (1000) and the long side (1018) of the container (1010) faces away from the device (1000). The recessed bottom (FIG. 1, 114) is placed over the die-cut post (1003), as demonstrated in FIG. 7 such that the recessed bottom (FIG. 1, 114) encompasses the die-cut post (1003), and the die-cut post (1003) is at least partially contained by the recessed bottom (FIG. 1, 114).

Figure 10B:
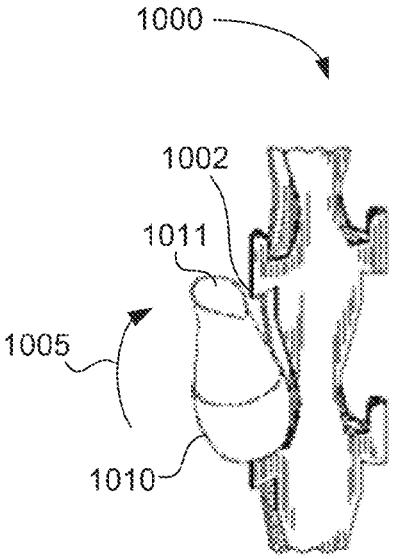

In FIG. 10B, the container (1010) is rotated to align with the die-cut post (1003) as indicated by the arrow (1005). More specifically, the container (1010) is tilted such that the angled top (1011) is proximate with the die-cut angle (1002) while the recessed bottom (FIG. 1, 114) remains held in place via the die cut protrusion (1003) protruding into the recess of the recessed bottom (FIG. 1, 114).

Figure 10C:
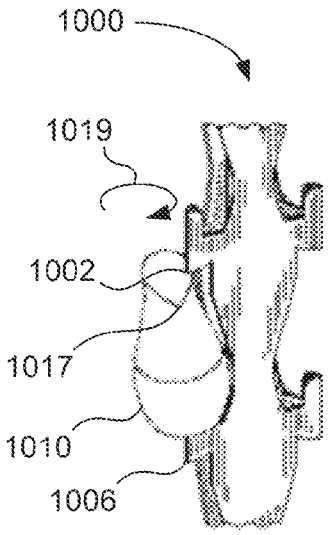

As illustrated in FIG. 10C, the container (1010) is rotated about an axis created by a fold (1006) passing through the die-cut angle (1002) and the die-cut post (FIG. 1, 103). The rotation is indicated by the arrow (1019). During the rotation, the short side (1017) of the container is rotated away from the device (1000), while the long side (1018) is rotated toward the device (1000). The resulting placement of the container (1010) results in the container (1010) being held in the device (1000). More specifically, the die-cut angle (1002) exerts a lateral force against the angled top (FIG. 1, 111) such that the container (1010) is retained against the device (1000).

Figure 10D:
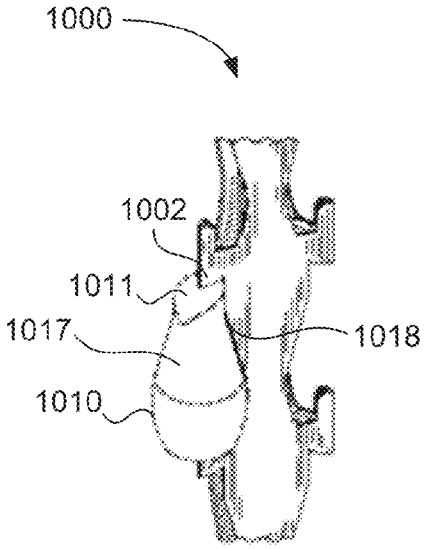

As illustrated in FIG. 10D, once the container (1010) is inserted into the device (1000), the combination of the die-cut post (1003) within the recessed bottom (1014) and the die-cut angle (1002) retaining the angled top (1011), the container (1010) is held by the device (1000) for display. In this orientation, the short side (1017) of the container (1010)

faces away from the device (1000), while the long side (1018) of the container (1010) faces towards the device (1000).

To remove the container (1010) from the device (1000), the above described steps may be performed in reverse. More specifically, the container (1010) is rotated about an axis such that the short side (1017) of the container (1010) is rotated towards the device (1000). The container (1010) may then be tilted away from the device (1000) and the container (1010) may be lifted off the device (1000) such that the die-cut post (1003) is no longer encompassed by the recessed bottom (1014).

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A device for displaying a number of containers, the device comprising:

a number of stations to receive a number of containers, each container having an angled top and recessed bottom, each station comprising:

an opening with a first end and a second end opposite of one another to receive a container;

at the first end of the opening, a pointed overhang formed where two sides of the device meet, a line where the two sides meet being parallel to a longitudinal axis of a container when placed in the opening, with the sides each having an angle matching the angled top of the container; and a post at the second end of the opening to retain the container via the recessed bottom, wherein the container is fully received in the opening by rotating the container such that the long side of the angled top of the container slides behind the overhang of the opening.

2. The device of claim 1, wherein the line where the two sides meet being a fold in a continuous substrate that is passing through the pointed overhang and post of a respective station.

3. The device of claim 1, wherein the container has curved sides along the longitudinal axis, and the opening is shaped with a shape corresponding to a contour of the container.

4. The device of claim 1, wherein the device is constructed with a plurality of sides to form a freestanding display.

5. The device of claim 1, wherein the device is inserted into a base to form a freestanding display.

6. The device of claim 1, wherein the container has a circular cross-section centered on the longitudinal axis of the container, the pointed overhang and post being arranged on the longitudinal axis when a container is received in a corresponding station.

7. The device of claim 1, wherein the overhang is configured to hold the container in line with the post when a container is received in a corresponding station.

8. The device of claim 1, the device having three sides and a triangular cross-section, a vertical column of stations to receive containers being disposed on at least one corner of the triangular cross-section.

9. A system for displaying a container, the system comprising:

a number of containers, each container comprising a circular cross-section, a central axis centered on the circular cross section, an angled top and a recessed bottom;

a number of stations for displaying the number of containers, with stations being arranged vertically one above another and wherein a first station is directly above a second station, each station comprising:

an opening to receive a container, the opening comprising:

at a first end of the opening, a point at a bottom of an edge where two sides of a container support device meet to form an overhang, the edge being along the central axis of a container when placed in the opening, with the sides each having an angle matching, and to retain, the angled top of the container placed in the opening; and a post at a second end of the opening extending along the central axis of the container placed in the opening, to extend into and retain the recessed bottom of the container, wherein, when the post is inserted in the recessed bottom of the container, a most distal portion of the angled top of the container extends above the point of the overhang such that the container is fully received in the opening by rotating the container such that the most distal portion of the angled top of the container slides behind the overhang of the opening.

10. The system of claim 9, the container support device having three sides and a triangular cross-section, and a vertical column of openings of said number of stations to each receive one of said number of containers, said openings being disposed on at least one corner of the triangular cross-section.

11. The system of claim 10, wherein a vertical column of openings of said number of stations to each receive one of said number of containers is disposed on at least two corners of the triangular cross-section.

12. The system of claim 9, wherein the edge where the two sides of the container support device meet being a fold in a continuous substrate.

13. The system of claim 9, wherein the system is freestanding.

14. The system of claim 9, wherein the two sides provide support for the system to stand on a surface.

15. The system of claim 10, wherein the three sides create an enclosure around the triangular cross-section, the enclosure being hollow along a longitudinal axis.

16. The system of claim 9, wherein a diameter of the circular cross-section varies along the central axis of the container and the opening is shaped in a contour of the container.

17. A method for making the device of claim 1, comprising:

forming the number of stations in a substrate by die cutting the substrate corresponding to the openings including the pointed overhang with sides angled to match the angled top of the container and the post; and folding the substrate through the die cut to form the pointed overhang and post at each of the number of stations.

18. The method of claim 17, further comprising forming a display mechanism in the substrate for supporting the device as a display.

19. The method of claim 17, further comprising forming two folds, wherein each fold passes through a series of die-cut openings with a pointed overhang and a post to form multiple columns of stations to receive containers.

20. The method of claim 19, wherein the folds create a triangular cross-section for the device.

* * * * *